United States Patent [19]

Engelbrecht et al.

[11] 4,454,078

[45] Jun. 12, 1984

[54] MIXING SYSTEMS HAVING AGITATORS FOR MIXING GAS WITH LIQUID

[75] Inventors: Horst P. Engelbrecht, Canadaigua; Ronald J. Weetman, Rochester, both of N.Y.

[73] Assignee: General Signal Corporation, Stamford, Conn.

[21] Appl. No.: 205,378

[22] Filed: Nov. 10, 1980

[51] Int. Cl.[3] ..... B01F 3/04

[52] U.S. Cl. ..... 261/93; 209/169; 210/221.2; 366/102

[58] Field of Search ..... 261/93, 87, 84; 209/169; 210/220, 221.1, 221.2; 55/230, 231, 247, 256; 366/101, 102, 107

[56] References Cited

U.S. PATENT DOCUMENTS

| | | | |
|---|---|---|---|
| 2,246,559 | 6/1941 | Weinig | 261/93 |
| 3,574,331 | 4/1971 | Kurosawa et al. | 261/93 |
| 3,700,103 | 10/1972 | Giebel | 261/93 |
| 3,875,057 | 4/1975 | Kaelin | 261/93 |
| 3,984,001 | 10/1976 | Nagand et al. | 261/93 |
| 4,207,275 | 6/1980 | Stanton, Jr. et al. | 210/221.2 |

*Primary Examiner*—Richard L. Chiesa

*Attorney, Agent, or Firm*—Jeffrey S. Mednick; Harold Wynn; Thomas R. Fitzgerald

[57] ABSTRACT

A motor rotated agitator is adapted to be inserted within a container of liquid wherein the agitator has a plurality of curved blades secure at their top edges to a disc adapted to be rotated by a motor. The lower edges of the blades have a circular plate secure thereto, having a central circular opening for input of fluid to inner ends of the blades. A sparge ring is disposed about the periphery of the agitator for ejecting a gas into output of fluid at the periphery of the agitator in an area spaced from the input area of the agitator, which is limited by use of the circular plate.

4 Claims, 8 Drawing Figures

FIG. 3
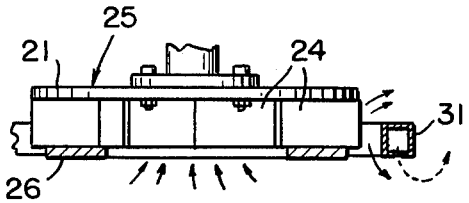
FIG. 4
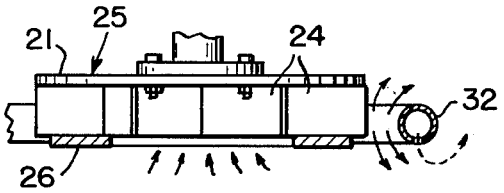
FIG. 5
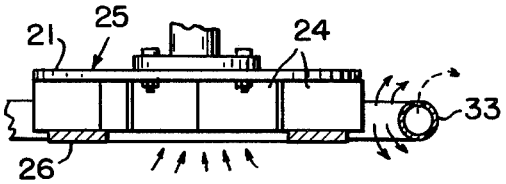
FIG. 6
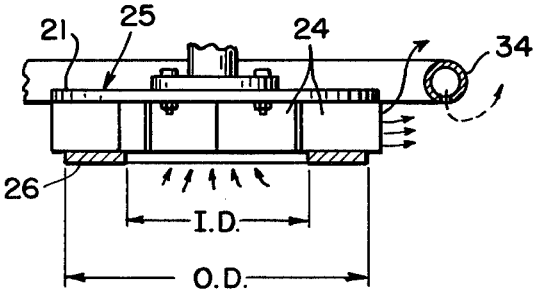
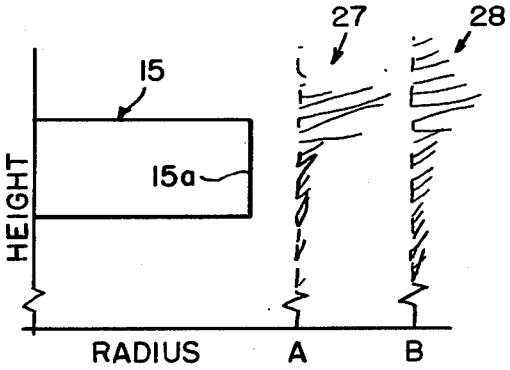
FIG. 8 (PRIOR ART)
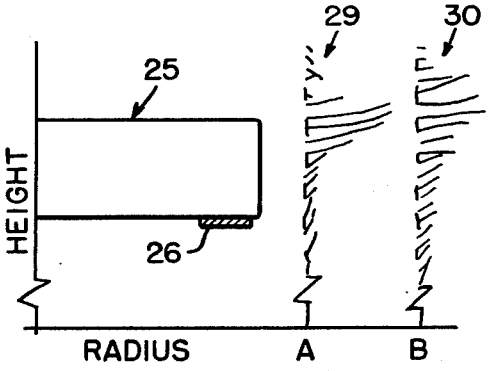
FIG. 7

MIXING SYSTEMS HAVING AGITATORS FOR MIXING GAS WITH LIQUID

REFERENCE TO PRIOR DISCLOSURES

The Booth U.S. Pat. No. 2,433,592, the Lefrancois U.S. Pat. No. 3,536,305, and the Stanton, Jr., et al. U.S. Pat. No. 4,207,275, are of interest as background material relative to the present invention. The prior Stanton, Jr., et al. application, assigned to the same assignee as the present invention, is incorporated herein by reference as disclosure of background material.

BACKGROUND OF THE INVENTION

This invention related to agitators for mixing liquid with gas, and while the invention is subject to a wide range of applications, a preferred embodiment of the invention will be particularly described as applied to an improved agitator for mixing liquid with a gas.

A conventional system for mixing a gas with a liquid involves supplying gas to an input of a rotating liquid agitator. This is insufficient because output of the agitator is limited by the presence of gas in its input, as was fully discussed in the prior U.S. Stanton, Jr., et al. U.S. Pat. No. 4,207,275, issued June 10, 1980. The system according this prior patent provides an improvement that prevents the mixing of gas with the input to the impeller by ejecting the gas upwardly through orifices in a sparge ring at the periphery of an agitator. It is desirable in this type of a system to keep the system running as continuously as possible in order to prevent the possibility of settling solids from obstructing the orifices in the sparge ring.

An object of the present invention is to provide agitators for mixing liquid with gas which substantially obviate one or more of the limitations and disadvantages of the described prior art systems.

Another object of the present invention is to segregate input and output areas of an agitator for facilitating mixing of the agitator output with a gas, while limiting gas input to the agitator.

Another object of the present invention is to improve the efficiency, and thus reduce the cost of operation, of systems for mixing a gas with a liquid.

Other objects, purposes and characteristic features of the present invention, will be in part obvious from the accompanying drawings, and in part pointed out as the description of the invention progresses.

SUMMARY OF THE INVENTION

The mixing system according to the present invention provides an agitator for mixing gas with a liquid within a container comprising a motor rotated agitator having a fixed sparge ring disposal about its periphery for circulating liquid over the sparge ring and mixing gas output of the sparge ring with liquid output of the agitator. The agitator has a solid disc adapted to be secured on one side to a motor driven shaft, and having agitator blades secured along one edge to the other side of the disc. The agitator has a circular lower cover plate secured to the lower edge of the agitator blades, the cover plate having a central opening spaced away from the sparge ring to permit induction of fluid into a limited area including the inner ends only of the agitator blades, within a limited area spaced from the sparge ring. This provides that liquid can be expelled from the outer ends of the blades of the agitator at an angle closer to normal relative to an axis of rotation of the disc than would be provided without the cover plate. This provides better distribution of a liquid around the sparge ring to provide for improved mixing of gas with a liquid without drawing the gas into the input area of the agitator.

IN THE DRAWINGS

FIG. 3 is an elevational view, partly in cross section, of the agitator of FIG. 2 together with a sparge ring having gas orifices in the bottom thereof;

FIG. 4 is an elevational view, partly in cross section, of the agitator of FIG. 2 in combination with a sparge ring of circular cross section having orifices in the bottom thereof;

FIG. 5 is an elevational view, partly in cross section, of the agitator of FIG. 2 in combination with a sparge ring of circular cross section having orifices in the top thereof;

FIG. 6 is an elevational view, partly in cross section, of the agitator of FIG. 2 in combination with a sparge ring of circular cross section having orifices in the bottom thereof wherein the sparge ring is located partly above the agitator;

FIG. 7 is a chart illustrating the flow pattern of an agitator according to the preferred embodiment of the present invention as shown in FIG. 2; and illustrating the flow pattern of a prior art agitator;

FIG. 8 is a chart as shown in FIG. 1, without a lower cover plate.

Figure 1:
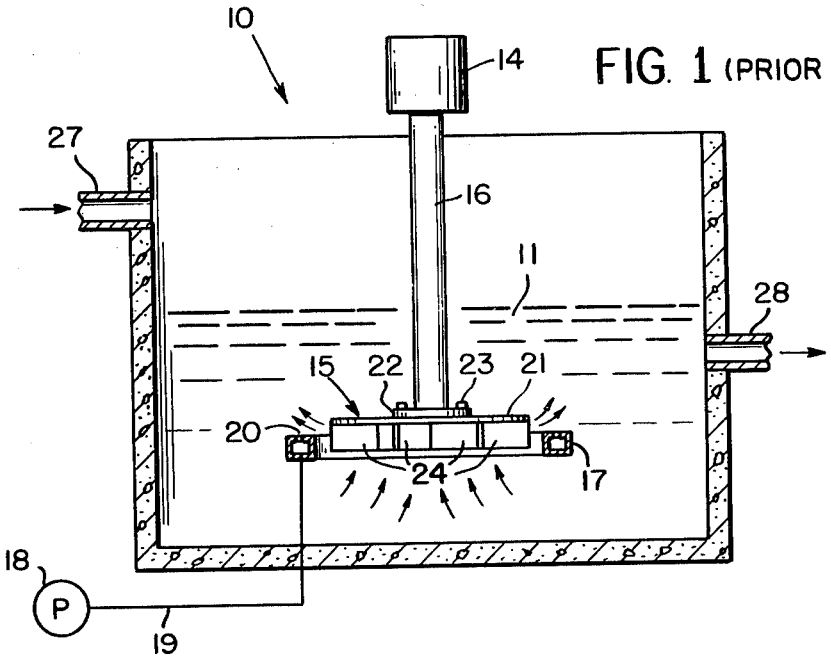
FIG. 1 (PRIOR ART)
FIG. 1 is an elevational view, partly in cross section, of a mixing system according to the prior art using an agitator and a sparge ring in a tank of liquid for mixing a gas with a liquid.
Figure 2:
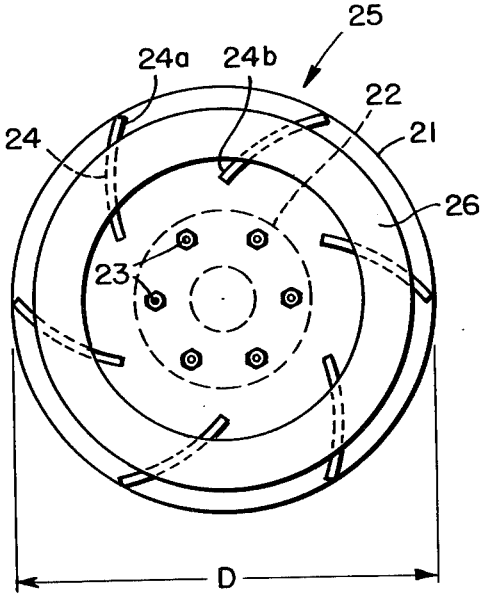
FIG. 2 is a bottom view of an agitator according to a preferred embodiment of the present invention.

With reference to FIGS. 1 and 2, a mixing system 10 is disclosed for mixing a liquid 11 with a gas 12 within a container 13 comprising a motor 14 driving an agitator 15 through a shaft 16, the agitator 15 being disposed below the level of the liquid 15 in the container 13 for circulating the liquid 11 over a sparge ring 17. The sparge ring 17 has gas applied thereto under pressure by a suitable pump 18, through a passage 19 to cause bubbles of gas to rise from orifices 20 in the top of the sparge ring 17 for mixing with liquid output about the periphery of the agitator 15.

The prior art agitator 15 of FIG. 1 has a disc 21 suitably secured at its top side to the shaft 16 by a flange 22 and bolts 23. The other side of the disc 21 has curved agitator blades 24 secured thereto along one edge of the blades 24, the blades 24 being preferably curved and is shown in FIG. 2 and extending in a generally radial direction relative to the axis of the disc 21 for inducing liquid into the inner ends **24*a* of the blades 24 as the disc 21 is rotated, and expelling the liquid from outer ends 24*b* of the blades over the sparge ring 17 to mix gas bubbles from the sparge ring 17 and the liquid 11**.

The present invention as shown in FIGS. 2–6 comprises an agitator 25 that is similar to the agitator 15 that has been described, except that a lower cover plate 26 is secured to lower edges of the blades 24 for restricting input to the agitator 25 to an area adjoining the inner ends **24*a* within a central opening ID as shown in FIG. 6 in the lower plate 26. If the diameter of the disc 21 as shown in FIG. 2 is equal to D, the outside diameter OD of cover plate 26 is preferably 0.96D, while the inner diameter ID is of cover plate 26 preferably 0.76D. The inside diameter ID of cover plate 26 can be as small as 0.67D, without adversely affecting output of agitator 25, cover plate 26 can be the same as the outside diameter of the disc 21**.

In operation of the system according to the prior art as shown in FIG. 1, a liquid to be treated is fed into tank 13 through an inlet port 27 and has a gas mixed therewith by the mixing system involving the agitator 15 and the sparge ring 17 to oxidize the contents of the container 13, for example, and deliver an output from container 13 through an output port 28. This can be part of an industrial scrubbing operation, for example. The system can be equally effective in treating wastes other than industrial waste, such, for example, as organic waste.

The prior art agitator 15 of FIG. 1 has no lower plate such as the plate 26 or FIG. 2, and therefore, input to the agitator 15 is over a broad area of the bottom edges of the agitator blades 24 as is indicated by the solid arrows beneath the agitator 15. This provides an output flow pattern as is illustrated in FIG. 8, which is a true copy of an actual test pattern for indicating direction and rate of flow of liquid in the tank about the periphery of the agitator 15. The direction of the lines 27 of the chart indicate the direction of flow of the liquid 11 of FIG. 1 and the length of these lines is indicative of the rate of flow.

Lines 27 of FIG. 8 represent fluid velocity streak lines as tracked by a Laser Doppler Velocometer that scans the depth of liquid in a vertical line at a first selected radius A from the center line of agitator 15, that is a short distance away from the periphery 15*a* of agitator 16. Lines 28 represent magnitude and direction of flow of fluid at a radius B from the center line of agitator 15, which is farther away from agitator 15 and shows flow in substantially the same direction as at radius A, also with the maximum rate of flow occurring in an area above agitator 15.

It will be seen from the chart of FIG. 8 that the maximum rate of flow is obtained in an area above the top edge of the agitator 15, while the direction of flow is at an upward angle to the horizontal. For this type of an agitator, with no lower cover plate, it is desirable, as pointed out in the above Stanton, Jr., et al. patent that the sparge ring 17 be disposed with its orifices 20 in the top thereof to prevent mixing of the gas output of the sparge ring 17 with the liquid input to the agitator 16.

The system according to the present invention, however, provides an improved flow pattern that has two major advantages, one of which is that the agitator 25 input area is narrowed to space the agitator input away from the agitator output so that sparge rings can be used having at least some orifices on the lower sides of the rings to keep the orifices free of plugging by settling solids, without the possibility of the gas being drawn into the input of the agitator 25. With reference to FIG. 7, the use of the plate 26 provides another advantage in that it provides an improved output pattern for flow from the agitator 25, wherein the direction of flow is closer to being normal to the axis of the agitator 25 than in the case of the prior art agitator 15 having its flow pattern. This permits a maximum flow rate to occur opposite the periphery of agitator 25, according to the present invention, rather than above the agitator 25, as in the case for the prior art (see FIG. 8). With reference to FIG. 7, the flow charts for agitator 25 are shown wherein lines 29 are closer to indicating horizontal flow than the lines 27 of FIG. 8 associated with testing the agitator 15 at the same radius A from the center of the agitator. Also, upon comparing the line 29 and 27, it will be noted that the agitator 25 has its maximum rate of flow in an area below the top of agitator 25, while the agitator 15 has its maximum rate of flow above the top of agitator 15. A similar comparison can be made of lines 30 at radius B for agitator 25 with lines 28 at the same radius for agitator 15, which does not have the cover plate 26.

By use of the lower cover plate 26 on the agitator 25 as has been described, better mixing of a gas with the liquid is obtained by a better choice in the structure of the sparge rings to be used with the impeller 25 to satisfy different applications of practice. Because of output of the agitator 25 being closer to a horizontal plane, there is fluid flow around a sparge ring 31 (see FIG. 3) above and below the ring 31, where the ring 31 is opposite the periphery of the agitator 25, to provide for more thorough mixing of gas with the liquid, and to carry the gas in a direction away from the input to the agitator 25. This flow is indicated in FIGS. 3–5 wherein liquid flow direction is indicated by solid arrows and gas flow direction is indicated by broken arrows.

FIGS. 3–6 indicate different arrangements of sparge rings that can be used to advantage with the agitator 25 having a lower cover plate 26. The sparge ring 31 of FIG. 3 is square in cross section, having orifices in the bottom thereof, and with flow of fluid through the agitator 25 providing a substantially horizontal output the flow divides partly above and partly below the sparge ring 31, that is disposed a little below the longitudinal center of the blades 24. This carries streams of gas bubbles emitted from the sparge ring 31 radially away from the intake area of the agitator 25. This intake area is limited by the cover plate 26 as is indicated by the solid input liquid flow direction arrows near the center of the agitator 25.

With reference to FIG. 4, a sparge ring 32 of tubular cross section is disposed in the output flow of liquid from the agitator 25 so that the liquid flows partly above and partly below the sparge ring 32. Ring 32 has orifices in the bottom thereof which provide a flow of bubbles as indicated by the dotted arrow in a direction radially away from the input to the agitator 25. The tubular structure of the sparge ring 32 has an advantage of causing a smooth flow of fluid around the tube, with less turbulence, for example, than might be encountered with the sparge ring 31 of FIG. 3.

With reference to FIG. 5, a sparge ring 33 of tubular cross section is disposed slightly below the longitudinal centerline of the blades 24, and has orifices in the top thereof for discharging gas into the output of the agitator 25, which output divides partly above and partly below the sparge ring 33 to carry the gas bubbles radially away from the input area of the agitator 25.

With reference to FIG. 6, an agitator 34 of tubular cross section is disposed slightly above the mainstream output of the agitator 25, with orifices in the bottom thereof for mixing gas with the output of the agitator 25. This arrangement has the advantage of offering minimum resistance to the output flow from the agitator 25, and has the advantage that air bubbles mixing with output of the agitator 25 are carried radially away from the input of agitator 25. The sparge rings of FIGS. 3, 4 and 6 have the advantage that the orifices for delivery of gas can be partly or solely in the bottom of the sparge rings to guard against clogging of the orifices due to settling solids in the container 13 when the system is shut down.

Having thus described a mixing system for mixing a gas with a liquid having an improved agitator structure as a preferred embodiment of the present invention, it is to be understood that various modifications and alterations may be made to the specific embodiment shown, without departing from the spirit or scope of the invention.

What is claimed is:

1. A mixing system having an agitator rotated by a motor for mixing a gas with a liquid within a container comprising, mixing means including motor rotated agitator means having a fixed sparge ring about its periphery for circulating liquid over the sparge ring and mixing the gas with the liquid, wherein improved mixing means comprises:

(a) the agitator means having a single solid disc adapted to be secured on its upper side to a motor driven shaft, (b) the single solid disc having a plurality of agitator blades on its lower side only, the blades being secured along their upper edges to a lower side of the disc and extending in a generally radial direction relative to a central area of the disc for inducing liquid from the central area of the disc into the blades and expelling the liquid over the sparge ring to mix gas from the sparge ring with the liquid, (c) the agitator means including a lower cover plate for the agitator blades secured to lower edges of the agitator blades and having a central opening to permit input of fluid to the central area of the disc and into the agitator blades, but within an area spaced from the sparge ring as determined by the size of the central opening in the cover plate, (d) whereby liquid can be expelled from the outer ends of the agitator blades at an angle closer to normal relative to an axis of rotation of the disc than would be provided without the cover plate, and (e) the sparge ring comprising a ring of substantially square cross section having orifices for discharging gas downwardly into liquid output of the agitator.

2. A mixing system having an agitator rotated by a motor for mixing a gas with a liquid within a container comprising, mixing means including motor rotated agitator means having a fixed sparge ring about its periphery for circulating liquid over the sparge ring and mixing the gas with the liquid, wherein improved mixing means comprises:

(a) the agitator means having a single solid disc adapted to be secured on its upper side to a motor driven shaft, (b) the single solid disc having a plurality of agitator blades on its lower side only, the blades being secured along their upper edges to a lower side of the disc and extending in a generally radial direction relative to a central area of the disc for inducing liquid from the central area of the disc into the blades and expelling the liquid over the sparge ring to mix gas from the sparge ring with the liquid, (c) the agitator means including a lower cover plate for the agitator blades secured to lower edges of the agitator blades and having a central opening to permit input of fluid to the central area of the disc and into the agitator blades, but within an area spaced from the sparge ring as determined by the size of the central opening in the cover plate, (d) whereby liquid can be expelled from the outer ends of the agitator blades at an angle closer to normal relative to an axis of rotation of the disc than would be provided without the cover plate, and (e) the sparge ring comprising a ring of tubular cross section disposed above a fluid output area of the agitator, and the sparge ring having orifices for discharging gas downwardly into the output area of the agitator.

3. A mixing system having an agitator rotated by a motor for mixing a gas with a liquid within a container comprising, mixing means including motor rotated agitator means having a fixed sparge ring about its periphery for circulating liquid over the sparge ring and mixing the gas with the liquid, wherein improved mixing means comprises;

(a) the agitator means having a single solid disc adapted to be secured on its upper side to a motor driven shaft, (b) the single solid disc having a plurality of agitator blades on its lower side only, the blades being secured along their upper edges to a lower side of the disc and extending in a generally radial direction relative to a central area of the disc for inducing liquid from the central area of the disc into the blades and expelling the liquid over the sparge ring to mix gas from the sparge ring with the liquid, (c) the agitator means including a lower cover plate for the agitator blades secured to lower edges of the agitator blades and have a central opening to permit input of fluid to the central area of the disc and into the agitator blades, but within an area spaced from the sparge ring as determined by the size of the central opening in the cover plate, (d) whereby liquid can be expelled from the outer ends of the agitator blades at an angle closer to normal relative to an axis of rotation of the disc than would be provided without the cover plate, (e) the sparge ring comprising a ring of tubular cross section surrounding the agitator means having orifices therein whereby the circular shape of the ring causes liquid output of the agitator means to flow partly above and partly below the ring to mix with gas from the orifices in an area spaced away from the input area of the agitator as defined by the agitator cover plate, and (f) the orifices of the sparge ring being at least in part in the lower side of the sparge ring to limit plugging of the orifices when the system is inactive.

4. A mixing system for mixing a gas with a liquid according to claim 3 wherein the orifices of the sparge ring are solely in the bottom thereof to limit plugging of the orifices when the system is inactive.

* * * * *